US007056059B1

(12) United States Patent
Wong et al.

(10) Patent No.: US 7,056,059 B1
(45) Date of Patent: Jun. 6, 2006

(54) BOOM WITH RAMPED OR HORIZONTAL SKIRT STRUCTURE FOR SLOWING THE FLOW SPEED OF BUOYANT FLUIDS ON MOVING WATER FOR FLUID, CONTAINMENT, FLUID CONTAINMENT SYSTEM AND METHOD

(76) Inventors: Kau-Fui Vincent Wong, 8215 SW. 48th St., Miami, FL (US) 33155; Michael K. Miller, 2111 Nova Village Dr., Davie, FL (US) 33317

( * ) Notice: Subject to any disclaimer, the term of this patent is extended or adjusted under 35 U.S.C. 154(b) by 0 days.

(21) Appl. No.: 10/952,214

(22) Filed: Sep. 28, 2004

(51) Int. Cl.
*E02B 15/04* (2006.01)

(52) U.S. Cl. ..... 405/63; 210/242.1

(58) Field of Classification Search ..... 405/63, 405/60, 71, 72; 210/242.1
See application file for complete search history.

(56) References Cited

U.S. PATENT DOCUMENTS

| | | | | | |
|---|---|---|---|---|---|
| 3,710,577 | A * | 1/1973 | Matheson | 405/72 |
| 3,720,062 | A * | 3/1973 | Mack | 405/71 |
| 3,757,526 | A * | 9/1973 | Larsson | 405/72 |
| 3,839,869 | A * | 10/1974 | Green | 405/72 |
| 3,886,750 | A * | 6/1975 | Ayers et al. | 405/72 |
| 4,096,700 | A * | 6/1978 | Muramatsu et al. | 405/63 |
| 4,190,381 | A * | 2/1980 | Knaus et al. | 405/72 |
| 4,272,214 | A * | 6/1981 | Nyfeldt et al. | 405/72 |
| 4,610,794 | A * | 9/1986 | Tsahalis | 405/63 |
| 4,640,645 | A * | 2/1987 | Simpson et al. | 405/63 |
| 4,738,563 | A | 4/1988 | Clark | |
| 5,695,300 | A * | 12/1997 | Echols et al. | 405/63 |
| 6,743,367 | B1 | 6/2004 | Dreyer | |
| 6,778,469 | B1 | 8/2004 | McDonald | |
| 2004/0156266 | A1 | 8/2004 | McDonald | |

* cited by examiner

*Primary Examiner*—Frederick L. Lagman
(74) *Attorney, Agent, or Firm*—Frank L. Kubler

(57) ABSTRACT

A flow slowing boom for slowing the speed of a buoyant fluid floating on moving water having a direction of water movement and a water surface includes a support structure for positioning at the surface of a body of water across the direction of water movement; an anchoring structure for anchoring the support structure relative to the moving water; a skirt structure; and a pivot structure interconnecting the support structure and the skirt structure so that the skirt structure is pivotably suspended from the support structure and moving water pivots the skirt structure out of a suspended vertical orientation to any of a range of angles beyond vertical including horizontal, thereby constraining buoyant fluid to flow across the skirt structure to slow the speed of the fluid and thus to permit the fluid to buoy toward the water surface for containment. A boom system and method are also provided.

24 Claims, 5 Drawing Sheets

BOOM WITH RAMPED OR HORIZONTAL SKIRT STRUCTURE FOR SLOWING THE FLOW SPEED OF BUOYANT FLUIDS ON MOVING WATER FOR FLUID, CONTAINMENT, FLUID CONTAINMENT SYSTEM AND METHOD

FILING HISTORY

This application is related to disclosure document No. 559499 filed on Aug. 24, 2004.

BACKGROUND OF THE INVENTION

1. Field of the Invention

The present invention relates generally to the field of devices and systems for containing environmentally hazardous buoyant fluids spilled on water such as oil. More specifically the present invention relates to a flow slowing boom including a ramped or horizontal skirt structure for placement at the surface of a body of moving water across the direction of flow for slowing the speed of buoyant fluids in the water to permit the fluids to buoy toward the water surface for containment. The flow slowing boom preferably includes a support structure for deployment at the water surface and connected to a boom anchoring structure for maintaining the position of the support structure, and a skirt structure pivotably suspended from the support structure with pivot means so that water movement pivots the skirt structure out of a suspended vertical orientation to an average position of any of a range of angles beyond vertical at any of a range of angles between 30 degrees and 95 degrees from vertical in the direction of water flow, and preferably at an angle from vertical between 75 and 92 degrees in the direction of water flow, thereby constraining buoyant fluid to flow across the skirt structure thereby slowing the speed of the floating fluid and thus permitting the fluid to buoy to the water surface and become containable by at least one subsequent containment boom. The support structure preferably includes a floatation means, so that the pivot means extends below the floatation means to the skirt structure. The flow slowing boom preferably includes orienting anchor means the skirt structure lower end to orient the skirt structure at a desired angle relative to horizontal suitable for a particular water movement speed.

A boom system is further provided including the flow slowing boom for positioning across the direction of water flow and a downstream series or cascade of conventional containment booms also positioned across the direction of water flow.

A method is also provided of containing fluid floating on a body of moving water including the steps of providing a flow slowing boom having a support structure and a skirt structure pivotally suspended from the support structure, positioning the support structure along the surface of the body of water across the direction of water flow so that the skirt structure extends downwardly from the support structure, providing a boom anchoring structure; securing the support structure in position with the anchoring structure; permitting water movement to pivot the skirt structure to a position angled away from vertical as specified above, and providing at least one containment boom including a downwardly extending skirt portion, positioning the at least one containment boom across the direction of water flow and downstream of the flow slowing boom, such that fluid floating on the surface of the flowing water is slowed by the flow slowing boom, buoys closer to the water surface and at least a portion of the floating fluid is stopped and contained by the containment boom.

2. Description of the Prior Art

There have long been booms having vertical containment skirts and buoyant elements for placement in bodies of water to contain floating fluids capable of causing environmental damage, such as oil. These prior booms have always not been successful in containing floating fluids on moving water, and especially where the movement is rapid.

One prior boom is that of Dreyer, U.S. Pat. No. 6,743,367, issued on Jun. 1, 2004. Dreyer discloses a boom having a boom curtain with expandable pleated panels and the method of boom use. The boom includes a support system, an upper portion for connection to the support system and a main portion having several pleats for increasing the surface area of the boom. Other related prior art references include U.S. Pat. No. 4,738,563 issued to Clark in April of 1988; and U.S. Pat. No. 6,778,469 issued in August of 2004 to McDonald, and U.S. Patent Application 2004/0156266 filed in August of 2004 by McDonald.

It is thus an object of the present invention to provide a flow slowing boom for use in rapidly moving water which includes a skirt structure angled at an average position away from vertical to define a ramp so that fluid floating on the water is slowed as it passes along the skirt structure and thus rises toward the surface with buoyant force to become more readily contained by downstream conventional containment booms, and which can be caused to remain vertical when desired. The invention uses the power of nature by harnessing the energy of the water flow to pivot skirt on the pivot means to orient the skirt.

It is another object of the present invention to provide such a flow slowing boom in which the skirt structure can be oriented at a selected angle relative to vertical through the securing of ballast or anchoring means to the skirt structure.

It is still another object of the present invention to provide a boom system including the flow slowing boom and at least one containment boom and which is suitable for use in a variety of sea conditions with any of a wide range of water current speeds.

It is finally an object of the present invention to provide a method of deploying such a boom system which requires minimal effort, man hours and skill.

SUMMARY OF THE INVENTION

The present invention accomplishes the above-stated objectives, as well as others, as may be determined by a fair reading and interpretation of the entire specification.

A boom system is provided for containing or excluding buoyant fluid floating on moving water having a direction of water movement, including a flow slowing boom having a support structure for positioning at the surface of a body of water across the direction of water movement; an anchoring structure for anchoring the support structure relative to the moving water; a stiff skirt structure which is one of planar and convex in cross-sectional shape against the direction of water movement; and a pivot structure interconnecting the support structure and the skirt structure so that the skirt structure is pivotably suspended from the support structure and moving water pivots the skirt structure out of a suspended vertical orientation to an average orientation at any of a range of angles between thirty degrees and ninety-five degrees in the direction of water movement beyond vertical including horizontal, thereby constraining buoyant fluid to flow across the skirt structure to slow the speed of the fluid and thus to permit the fluid to buoy toward the water surface; and at least one containment boom having an upright skirt portion extending downwardly into the moving water, positioned downstream of the flow slowing boom across the direction of water movement.

A flow slowing boom is also provided for slowing the speed of a buoyant fluid floating on moving water having a direction of water movement and a water surface, the flow slowing boom including a support structure for positioning at the surface of a body of water across the direction of water movement; an anchoring structure for anchoring the support structure relative to the moving water; a skirt structure; and a pivot structure interconnecting the support structure and the skirt structure so that the skirt structure is pivotably suspended from the support structure and moving water pivots the skirt structure out of a suspended vertical orientation to an average orientation at any of a range of angles between thirty degrees and ninety degrees in the direction of water movement beyond vertical including horizontal, thereby constraining buoyant fluid to flow across the skirt structure to slow the speed of the fluid and thus to permit the fluid to buoy toward the water surface for containment.

The flow slowing boom support structure preferably includes a support cable extending in tension between two fixed the anchoring structures. The anchoring structures preferably includes at least one of: a piling, a tower, a pier and a weight anchor. The support structure preferably includes a floatation system for buoying the support structure to the water surface.

The flow slowing boom preferably additionally includes a flexible fabric, where the pivot structure includes at least a portion of the flexible fabric extending downwardly from the support structure to the skirt structure. The skirt structure preferably includes a series of upright skirt sections laterally linked together and enveloped by the fabric. The skirt sections each preferably include at least one stiff region having a series of upright stiffening elements.

The floatation system preferably includes at least one float. The at least one float preferably is wrapped in fabric. The at least one float preferably includes one of: expanded polystyrene, a synthetic foam, cork, and an air bag.

The flow slowing boom preferably additionally includes ballast secured at the lower end of the skirt structure for orienting the skirt structure at a selected angle relative to horizontal. The flow slowing boom preferably additionally includes a horizontal ballast sleeve formed of the fabric at the lower end of the skirt structure, where the ballast is retained within the ballast sleeve.

The ballast preferably includes one of: a ballast cable and a plurality of discrete weights. The flow slowing boom preferably additionally includes a skirt structure orienting anchor structure secured to the lower end of the skirt structure. The fabric preferably is one of: oleophilic; resistant to ultraviolet light and nonbiodegradable.

The flow slowing boom preferably additionally includes at least one tow cord secured to the support structure for engagement by water vessels for use in pulling the flow slowing boom through the water, for greater ease of deployment and retrieval of the flow slowing boom and for moving the flow slowing boom to new positions and to different containment sites.

A flow slowing boom for slowing the speed of a buoyant fluid floating on moving water having a direction of water movement and a water surface, the flow slowing boom including a support structure for positioning at the surface of a body of water across the direction of water movement; an anchoring structure for anchoring the support structure relative to the moving water; a skirt structure connected to the support structure such that the skirt structure is positioned out of a vertical orientation to an angle in a range of beyond vertical including horizontal, thereby constraining buoyant fluid to flow across the skirt structure to slow the speed of the fluid and thus to permit the fluid to buoy toward the water surface for containment.

The flow slowing boom preferably additionally includes at least one tow cord secured to the support structure for engagement by water vessels for use in pulling the flow slowing boom through the water, for greater ease of deployment and retrieval of the flow slowing boom and for moving the flow slowing boom to new positions and to different containment sites.

A flow slowing boom is further provided for slowing the speed of a buoyant fluid floating on moving water having a direction of water movement and a water surface, the flow slowing boom including a support structure for positioning at the surface of a body of water across the direction of water movement; an anchoring structure for anchoring the support structure relative to the moving water; a stiff skirt structure connected to the support structure so that the skirt structure is positioned out of a vertical orientation to an angle in a range of beyond vertical including horizontal, thereby constraining buoyant fluid to flow across the skirt structure to slow the speed of the fluid and thus to permit the fluid to buoy toward the water surface for containment.

A flow slowing boom is still further provided for slowing the speed of a buoyant fluid floating on moving water having a direction of water movement and a water surface, the flow slowing boom including a support structure for positioning at the surface of a body of water across the direction of water movement; an anchoring structure for anchoring the support structure relative to the moving water; a buoyant skirt structure which is one of planar and convex having a convex first broad face and a second broad face and for floating on the body of water with the first broad face directed downwardly so that the average position of the skirt structure is horizontal, thereby constraining buoyant fluid to flow across the skirt structure to slow the speed of the fluid and thus to permit the fluid to buoy toward the water surface for containment.

A method of containing or excluding from an area a quantity of fluid floating on a body of moving water having a water surface includes the steps of providing a flow slowing boom comprising a skirt structure and a support structure connected to the skirt structure; orienting the skirt structure at an angle which is one of parallel to the water surface, and angled downwardly along the direction of water movement to an average orientation at any of a range of angles between thirty degrees and ninety-five degrees from vertical, to define a surface over which the fluid is constrained to pass; providing an anchoring structure; securing the support structure in position in the body of moving water with the anchoring structure; and providing at least one containment boom including a skirt portion extending downwardly into the body of moving water, positioning the at least one containment boom across water flow and downstream of the flow slowing boom; so that fluid floating on the surface of the flowing water is slowed by the flow slowing boom, buoys closer to the water surface and at least a portion of the floating fluid is stopped and contained by the at least one containment boom.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
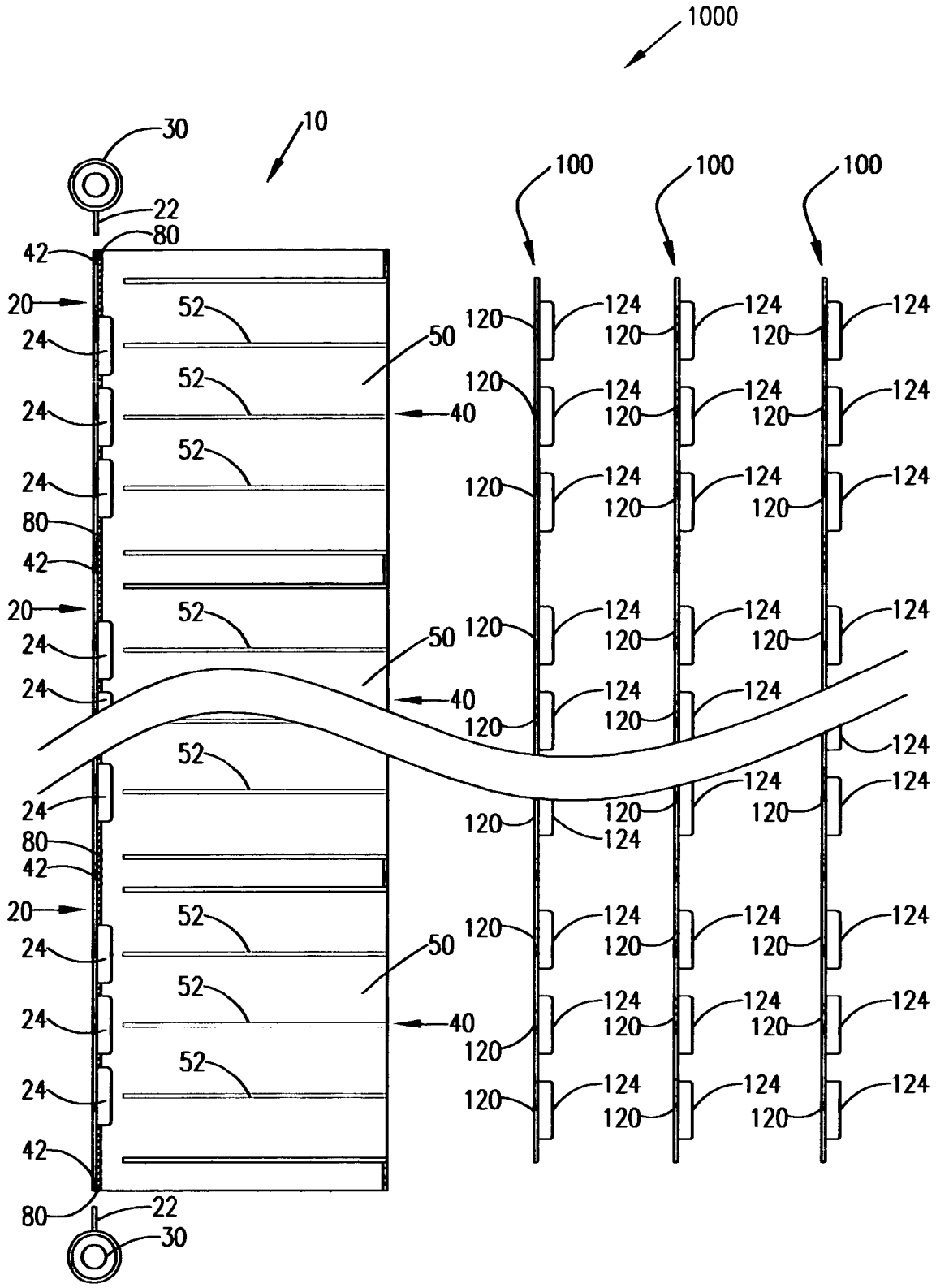
FIG. 1 is a top view of the preferred boom system, shown with a break in the middle.
Figure 2:
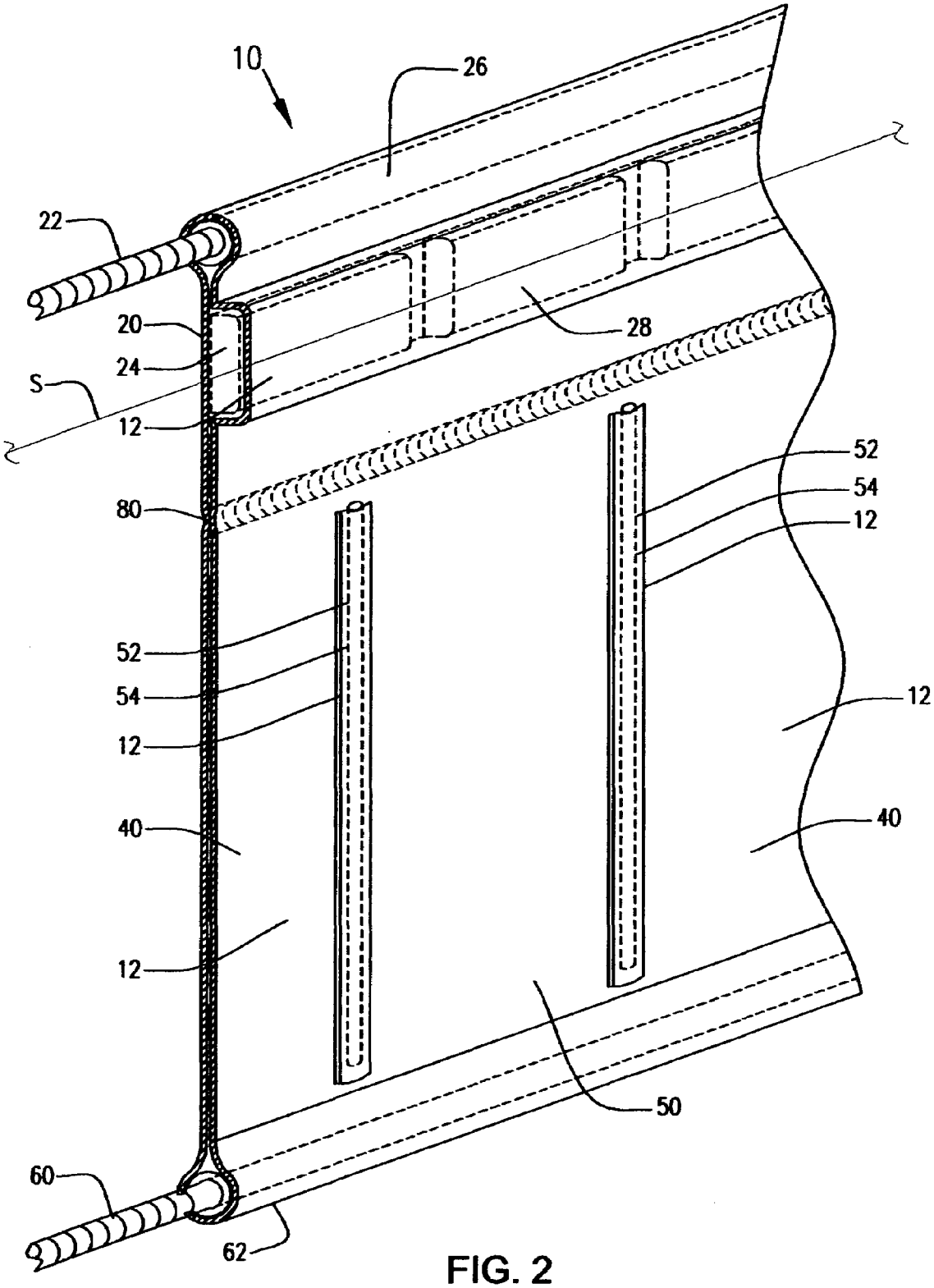
FIG. 2 is a perspective and broken away side view of the preferred flow slowing boom.
Figure 3:
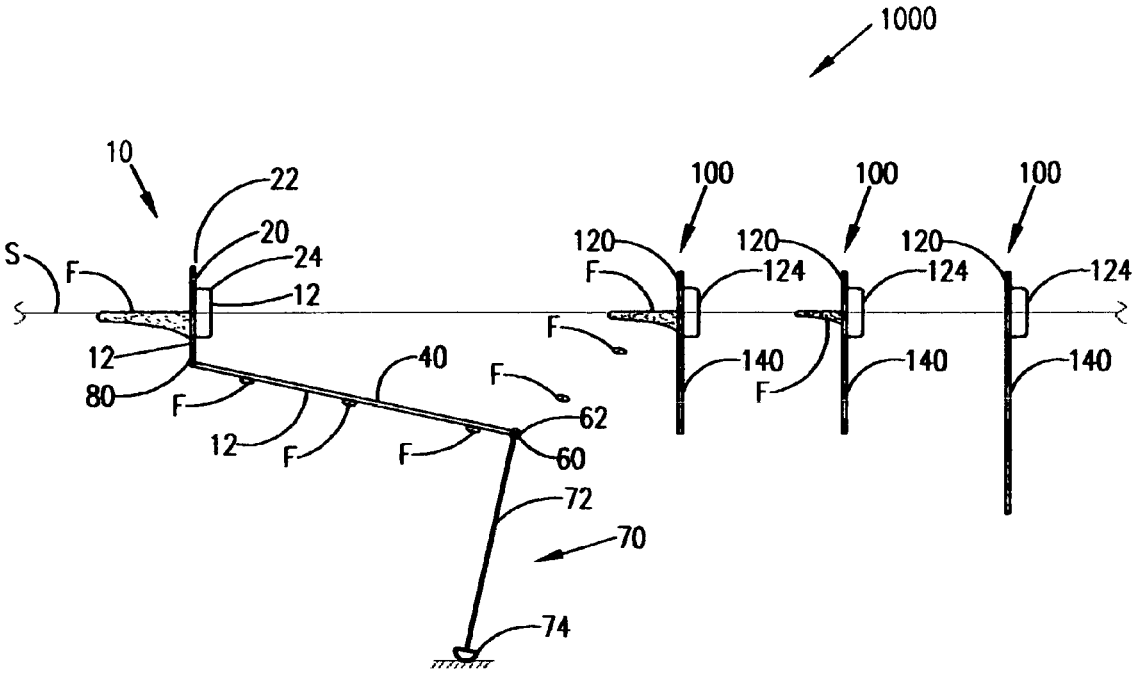
FIG. 3 is a side view of the boom system of FIG. 1. The progressive collection of floating fluid by the boom system is illustrated.
Figure 4:
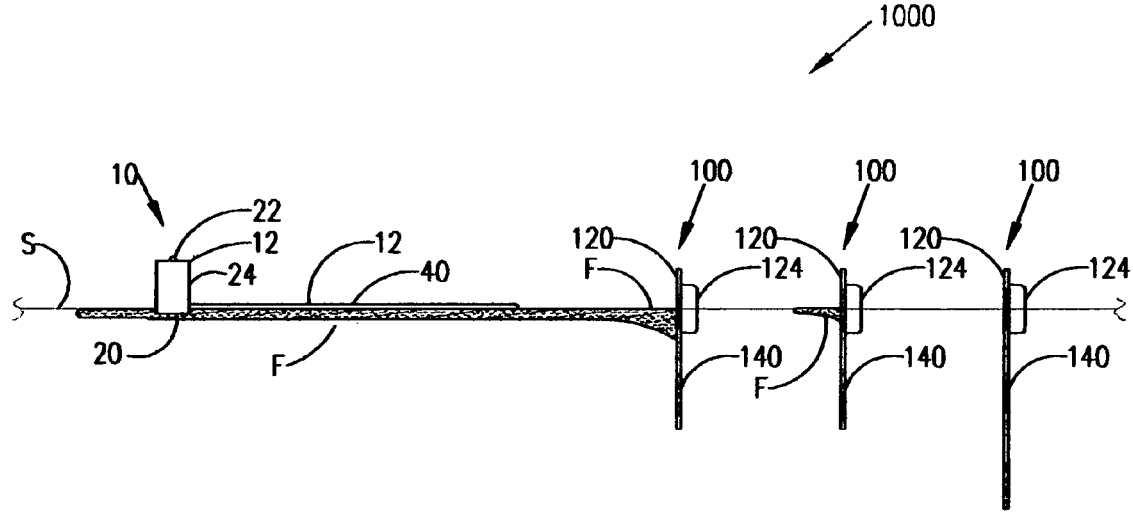
FIG. 4 is a side view of an alternative version of the boom system in which the flow slowing boom skirt is entirely buoyant and floats substantially horizontally on the water surface. Once again, the progressive collection of floating fluid by the boom system is illustrated.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–6, a flow slowing boom 10 is disclosed including a support structure 20 for anchoring in a body of moving water and positioning at the water surface S across the direction of water flow so that the support structure 20 protrudes above the water surface S and thereby prevents the fluid F from flowing over the top of flow slowing boom 10, and a rigid or stiff skirt structure 40 which preferably is either planar or convex in cross-sectional shape against the direction of water movement pivotably suspended from the support structure 20 with pivot means 80 so that water movement pivots the skirt structure 40 out of a vertical orientation to an average position at any of a range of angles between 30 degrees and 95 degrees from vertical in the direction of water flow, and preferably at an angle from vertical between 75 and 92 degrees in the direction of water flow, thereby constraining a buoyant target fluid F floating at and near the water surface S to flow across the skirt structure 40 adjacent to the underside of skirt structure 40, thereby slowing the speed of the floating fluid F and thus permitting the fluid F to buoy to the water surface S and become containable by at least one subsequent containment boom 100. The containment boom 100 may be of conventional upright skirt configuration and is positioned and anchored by conventional means to extend across the direction of water flow downstream of the flow slowing boom 10. The term "average position" is used throughout this application and in the claims to indicate the average or central position of a portion of the flow slowing boom 10 such as the skirt structure 40 within a repeating range of positions as the portion of boom 10 moves with cyclic wave or current action.

Support structure 20 preferably includes a support cable 22 extending in tension between two fixed boom anchoring structures 30 which are permanent or semipermanent such as pilings, towers or piers, or between combinations of these structures, with floatation means connected to the support structure 20. The floatation means preferably includes a series of floats 24 supporting the support cable 22 between boom anchor structures 30. Alternatively the support structure 20 may include the support cable 22 and a more extensive system of floats 24, retained by fixed boom anchor structures 30 in the form of weight anchors extending from some of the floats 24. The pivot means 80 preferably includes fluid impermeable and flexible fabric 12. Fabric 12 is also wrapped around the support cable 22 and extends downward to the skirt structure 40. One or more floats 24 preferably are retained in a horizontal float sleeve 28 of fabric 12 formed below and adjacent to the cable sleeve 26, or may be a series of discrete pockets for receiving and retaining individual floats 24. The skirt structure 40 preferably includes a series of upright skirt sections 50 laterally linked together by fabric connecting segment 42 formed of fabric 12 and contained by the fluid impermeable fabric 12. The skirt sections 50 in turn preferably each include several stiff regions 52 formed of upright stiffening elements 54 such as carbon rods or metal rods enveloped by the fabric 12. By way of example only, each skirt section 50 shown in FIG. 1 includes three stiff regions 52. Fabric 12 may be one continuous sheet of a single fabric material, or may be formed of sections of different fabric materials sewn together.

Floats 24 preferably take the form of foam blocks wrapped in the fabric 12 adjacent to the support cable 22. The preferred float 24 material is expanded polystyrene (EPS), which must be sealed and shielded to prevent damage from the elements. Other contemplated float 24 materials include but are not limited to synthetic foams, cork, air bags and other plastics.

Ballast means 60 preferably are provided at the skirt structure 40 lower end and preferably extend along the entire length of the flow slowing boom 10 to orient the skirt structure 40 at a desired average angle relative to vertical suitable for a certain water flow speed. These ballast means 60 preferably are retained within a horizontal sleeve 62 of fabric at the skirt structure 40 lower end and may take the form of a ballast cable retained in tension using prior art structures and techniques, or a series of discrete weights. In high seas, ballast means 60 alone may be inadequate to position the skirt structure 40 in a suitable orientation. For these circumstances, anchor means in the form of a skirt structure orienting anchor system 70 is provided which preferably includes lines or chains 72 secured to the skirt structure 40 lower end and extending to anchors 74 such as mushroom anchors tied to lines or chains 72, may take the form of or a more sophisticated, environmentally friendly mooring system (not shown).

Where the floating fluid F to be contained is oil, the fabric 12 preferably is a single layer of oleophilic material, or in other words, material that attracts oil. The fabric 12 should have a high load distribution capacity, preferably is resistant to ultraviolet light and preferably is nonbiodegradable. A fabric 12 having a suitable tensile strength for a water current speed at a specific spill site and for a suitable permeability for a for a specific type of fluid to be contained can be selected from a variety of commercially available fabrics.

A series of tow cords 82 preferably is provided for convenient engagement by water vessels for pulling the flow slowing boom 10, for greater ease of boom 10 deployment and retrieval and for moving the boom 10 to new positions and containment sites. These tow cords 82 preferably are attached to the support structure 20 at regular intervals and extend the length of the boom 10, and preferably are nylon lifting straps or a polypropylene rope, or are formed of steel, aluminum cable, or a geosynthetic material. Boom interconnection lines 110 preferably are provided for interconnecting parallel positioned and spaced apart flow slowing boom 10 and a first containment boom 100 so that they can be towed with tow cords 82 into position downstream of a floating fluid F. Additional boom interconnection lines 110 preferably interconnect the first containment boom 100 and a parallel and spaced apart second containment boom 100 and interconnect the second containment boom 100 and a parallel and spaced apart third containment boom 100, so that the flow slowing boom 10 and the first and second containment booms 100 forming a boom cascade can be towed to a site downstream of floating fluid F and thereby deployed for use.

It is alternatively contemplated that the pivot means 80 be omitted and the support structure 20 and the skirt structure 40 be interconnected rigidly or integrally with the skirt structure 20 with the skirt structure 40 at a fixed angle relative to the support structure 20. It is preferred that the skirt structure 40 be planar, but a curvature back against the direction of fluid flow is acceptable. A skirt structure 40 bowed by the water and fluid flow like a sail in the wind, is not acceptable, and as a result the skirt structure 40 itself cannot be flexible.

Boom System

A boom system 1000 is provided including the flow slowing boom 10 for positioning across the direction of water current flow and a cascade of conventional containment booms 100 downstream of the flow slowing boom 10, preferably three containment booms 100, positioned in a downstream series, each extending across the direction of water flow. The first and second containment booms 100 in the downstream series preferably each include floats 124 and a skirt 140 about one meter in height, and the third containment boom 100 preferably includes a skirt 140 about one and one half meters in height, although the use of many other skirt 40 heights is contemplated. The distances between the flow slowing boom 10 and each of the containment booms 100 is selected to be appropriate to the flow characteristics of the particular site and of the floating fluid F to be contained.

Skirt structure 40 has a first broad face which is one of planar and convex against the direction of water movement, and has a second broad face opposite the first broad face. See FIGS. 5 and 5B. Skirt structure 40 is for positioning in the body of water with the first broad face directed downwardly so that the average position of said skirt structure 40 is horizontal.

Figures 5, 5A, 5B:
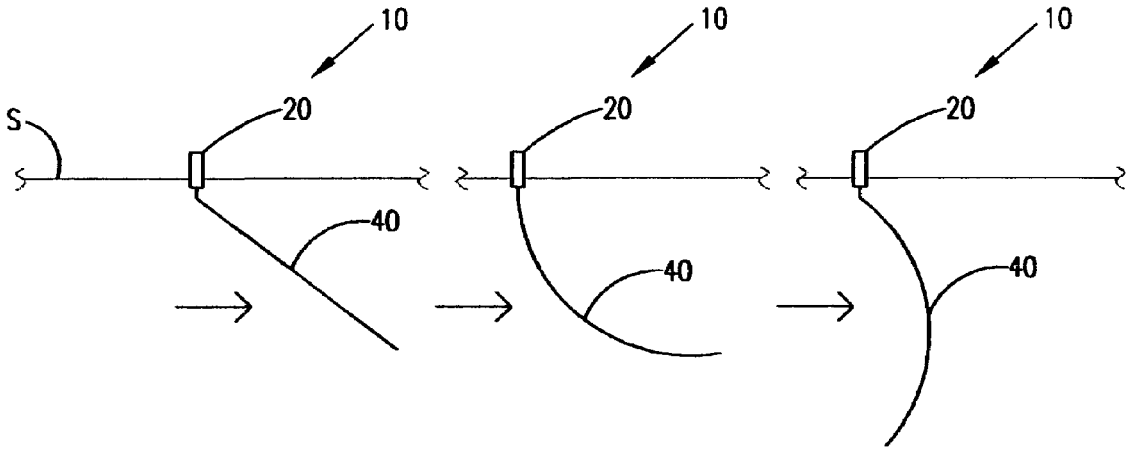
FIG. 5 is a schematic side view of the preferred flow slowing boom having a rigid skirt structure which is planar in cross-sectional shape.
FIG. 5A is a schematic side view as in FIG. 5 but showing the flow slowing boom skirt structure as being convex in cross-sectional shape against the direction of water movement indicated by the arrow, and is one of the preferred skirt configurations of the present invention.
FIG. 5B is a schematic side view as in FIG. 5 but showing the flow slowing boom skirt structure as being concave in cross-sectional shape against the direction of water movement indicated by the arrow, which may result either from the skirt structure being flexible or from the skirt structure being rigidly formed in this configuration. Either way, this configuration is considered highly inefficient and unsuitable, and is not a preferred embodiment of the present invention.
Figure 6:
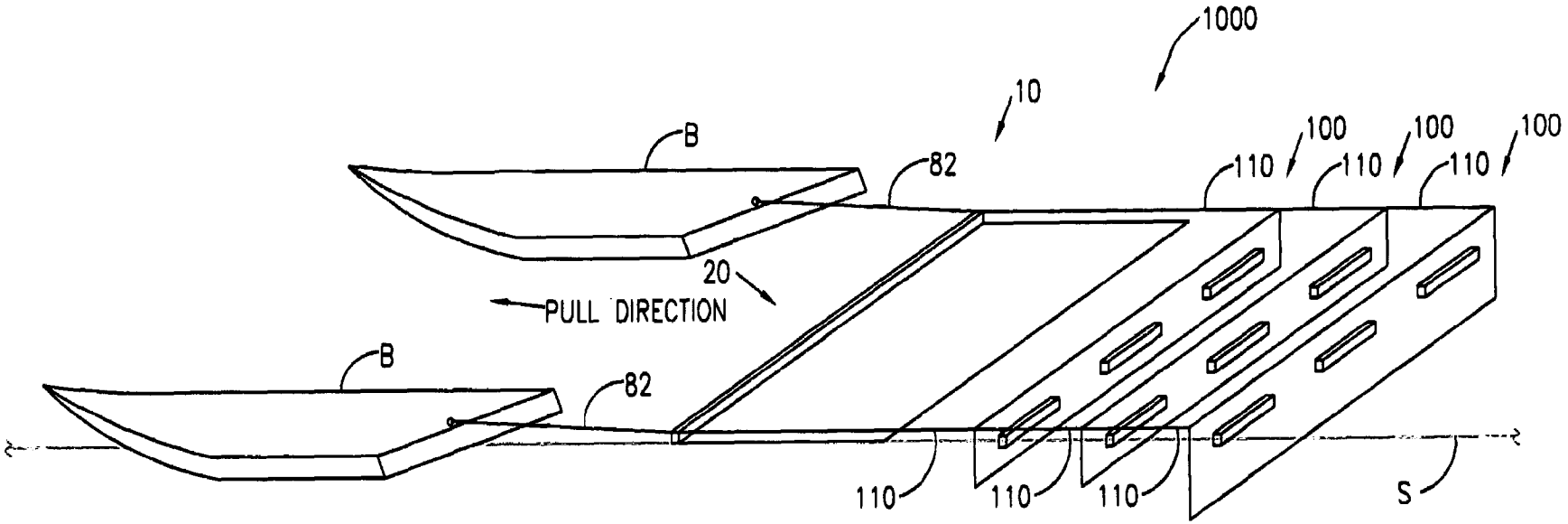
FIG. 6 is a schematic perspective view of the preferred boom system in which the booms are interconnected by interconnection lines and the system being towed with tow lines connected to two boats or other water craft.

FIG. 5B shows a skirt structure 40 having a first broad face which is concave against the direction of water movement. This configuration is considered highly inefficient or entirely unworkable, and thus is not a version of the preferred embodiment.

Second Preferred Embodiment

For a second embodiment of the flow slowing boom, the skirt structure 40 itself is buoyant and floats on the moving water with an average position which is horizontal. Skirt structure 40 preferably is flexible, but may be stiff. As a result, buoyant fluid F is constrained to flow across the skirt structure to slow the speed of the fluid F and thus to permit the fluid F to buoy toward the water surface S for containment.

Method

In practicing the invention, the following method may be used. A method is also provided of containing fluid floating on a body of moving water including the steps of providing a flow slowing boom 10 having a support structure 20 and a stiff skirt structure 40 pivotally suspended from the support structure 20, positioning the support structure 20 along the surface S of the body of water across the direction of water flow so that the skirt structure extends downwardly from the support structure, providing an anchoring structure; securing the support structure in position with an anchoring structure; permitting water movement to pivot the skirt structure to an average position of any of a range of angles between 30 degrees and 95 degrees from vertical in the direction of water flow, and preferably at an angle from vertical between 75 and 92 degrees in the direction of water flow, and providing at least one containment boom 100 including a downwardly extending skirt portion, positioning the at least one containment boom 100 across water flow and downstream of the flow slowing boom 10, such that fluid F floating on the surface S of the flowing water is slowed by the flow slowing boom 10, buoys closer to the water surface S and at least a portion of the floating fluid F is stopped and contained by the containment boom 100.

The use of mechanical pulling and lifting equipment is preferred in deploying the flow slowing boom 10 and the containment booms 100. Deployment preferably is from a barge or a dock with a small boat, or from a suitably located access structure. For example, booms 10 and 100 could be deployed from two water vessels.

A preferred method is also provided for practicing the steps of positioning the support structure 20 along the surface S of the body of water across the direction of water flow and positioning the at least one containment boom 100 across water flow and downstream of the flow slowing boom 10, including the steps of providing boom interconnection lines 110 extending between and interconnecting flow slowing boom 10 and a containment boom 100, and connecting a towing boat B to the tow cords 82 and simultaneously towing the flow slowing boom 10 and containment boom 100 into position across the direction of water flow.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A boom system for containing or excluding buoyant fluid floating on moving water having a direction of water movement, comprising:

a flow slowing boom comprising a support structure for positioning at the surface of a body of water across the direction of water movement; an anchoring structure for anchoring said support structure relative to the moving water; a stiff skirt structure which is one of planar and convex in cross-sectional shape against the direction of water movement; and pivot means interconnecting said support structure and said skirt structure such that said skirt structure is pivotably suspended from said support structure and moving water pivots said skirt structure out of a suspended vertical orientation to an average orientation at any of a range of angles between thirty degrees and ninety-five degrees in the direction of water movement beyond vertical, thereby constraining buoyant fluid to flow across said skirt structure to slow the speed of the fluid and thus to permit the fluid to buoy toward the water surface;

and at least one containment boom comprising an upright skirt portion extending downwardly into the moving water, positioned downstream of said flow slowing boom across the direction of water movement.

2. The flow slowing boom of claim 1, wherein said support structure comprises a floatation system for buoying said support structure to the water surface.

3. The flow slowing boom of claim 1, additionally comprising a flexible fabric, wherein said pivot means comprises at least a portion of said flexible fabric extending downwardly from said support structure to said skirt structure.

4. The flow slowing boom of claim 3, wherein said skirt structure comprises a series of upright skirt sections laterally linked together and enveloped by said fabric.

5. The flow slowing boom of claim 4, wherein said skirt sections each comprise at least one stiff region comprising a series of upright stiffening elements.

6. A flow slowing boom for slowing the speed of a buoyant fluid floating on moving water having a direction of water movement and a water surface, the flow slowing boom comprising:

a support structure for positioning at the surface of a body of water across the direction of water movement and protruding above the water surface a sufficient distance to obstruct the fluid from flowing over the top of support structure;

an anchoring structure for anchoring said support structure relative to the moving water;

a stiff skirt structure having a lower end;

and pivot means interconnecting said support structure and said skirt structure said skirt structure comprising a weight and size such that said skirt structure is pivotably suspended from said support structure and moving water pivots said skirt structure out of a suspended vertical orientation to an average orientation at any of a range of angles between thirty degrees and ninety-five degrees in the direction of water movement beyond vertical, thereby constraining the buoyant fluid to flow under and across said skirt structure to slow the speed of the fluid and thus to permit the fluid to buoy toward the water surface for containment.

7. The flow slowing boom of claim 6, wherein said flow slowing boom support structure comprises a support cable extending in tension between two fixed said anchoring structures.

8. The flow slowing boom of claim 6, wherein said anchoring structures comprise at least one of: a piling, a tower, a pier and a weight anchor.

9. The flow slowing boom of claim 6, wherein said support structure comprises a floatation system for buoying said support structure to the water surface.

10. The flow slowing boom of claim 9, wherein said floatation system comprises at least one float.

11. The flow slowing boom of claim 10, wherein said at least one float is wrapped in fabric.

12. The flow slowing boom of claim 11, wherein said at least one float comprises one of: expanded polystyrene, a synthetic foam, cork, and an air bag.

13. The flow slowing boom of claim 6, additionally comprising a flexible fabric, wherein said pivot means comprises at least a portion of said flexible fabric extending downwardly from said support structure to said skirt structure.

14. The flow slowing boom of claim 13, wherein said skirt structure comprises a series of upright skirt sections laterally linked together and enveloped by said fabric.

15. The flow slowing boom of claim 14, wherein said skirt sections each comprise at least one stiff region comprising a series of upright stiffening elements.

16. The flow slowing boom of claim 13, wherein said fabric is one of: oleophilic; resistant to ultraviolet light and nonbiodegradable.

17. The flow slowing boom of claim 6, wherein the weight of said skirt structure comprises ballast means secured at the lower end of said skirt structure for orienting said skirt structure at a selected angle relative to horizontal.

18. The flow slowing boom of claim 17, additionally comprising a horizontal ballast sleeve formed of said fabric at the lower end of said skirt structure, wherein said ballast means is retained within said ballast sleeve.

19. The flow slowing boom of claim 18, wherein said ballast means comprises one of: a ballast cable and a plurality of discrete weights.

20. The flow slowing boom of claim 6, additionally comprising a skirt structure orienting anchor means secured to the lower end of said skirt structure.

21. The flow slowing boom of claim 6, additionally comprising at least one tow cord secured to said support structure for engagement by water vessels for use in pulling said flow slowing boom through the water, for greater ease of deployment and retrieval of said flow slowing boom and for moving said flow slowing boom to new positions and to different containment sites.

22. A flow slowing boom for slowing the speed of a buoyant fluid floating on moving water having a direction of water movement and a water surface, the flow slowing boom comprising:

a support structure for positioning at the surface of a body of water across the direction of water movement and protruding above the water surface a sufficient distance to prevent the fluid from flowing over the top of support structure;

an anchoring structure for anchoring said support structure relative to the moving water;

a stiff skirt structure;

and pivot means interconnecting said support structure and said skirt structure such that said skirt structure is pivotably suspended from said support structure and moving water pivots said skirt structure out of a suspended vertical orientation to an average orientation at any of a range of angles between thirty degrees and ninety-five degrees in the direction of water movement beyond vertical, thereby constraining the buoyant fluid to flow under and across said skirt structure to slow the speed of the fluid and thus to permit the fluid to buoy toward the water surface for containment;

at least one tow cord secured to said support structure for engagement by water vessels for use in pulling said flow slowing boom through the water, for greater ease of deployment and retrieval of said flow slowing boom and for moving said flow slowing boom to new positions and to different containment sites;

at least one tow cord interconnecting said flow slowing boom to a water vessel;

at least one containment boom comprising an upright skirt portion extending downwardly into the moving water, for positioning downstream of said flow slowing boom across the direction of water movement to form a boom cascade;

and at least two laterally spaced apart boom interconnection lines interconnecting said flow slowing boom and said at least one containment boom such that said at least one containment boom can be towed in combination with said flow containment boom.

23. A flow slowing boom for slowing the speed of a buoyant fluid floating on moving water having a direction of water movement and a water surface, the flow slowing boom comprising:

a support structure for positioning at the surface of a body of water across the direction of water movement;

an anchoring structure for anchoring said support structure relative to the moving water;

a buoyant skirt structure which is one of planar and convex having a convex first broad face and a second broad face and for floating on the body of water with the first broad face directed downwardly such that the average position of said skirt structure is horizontal, thereby constraining buoyant fluid to flow under and across said skirt structure to slow the speed of the fluid and thus to permit the fluid to buoy toward the water surface for containment.

24. A method of containing or excluding from an area a quantity of fluid floating on a body of moving water having a water surface comprising the steps of:

providing a flow slowing boom comprising a stiff skirt structure and a support structure connected to the skirt structure;

orienting the skirt structure at an angle which is one of parallel to the water surface, and angled downwardly along the direction of water movement to an average orientation at any of a range of angles between thirty degrees and ninety-five degrees from vertical, to define a surface over which the fluid is constrained to pass;

providing an anchoring structure;

securing the support structure in position in the body of moving water with the anchoring structure;

and providing at least one containment boom including a skirt portion extending downwardly into the body of moving water, positioning the at least one containment boom across water flow and downstream of the flow slowing boom;

such that fluid floating on the surface of the flowing water is slowed by the flow slowing boom, buoys closer to the water surface and at least a portion of the floating fluid is stopped and contained by the at least one containment boom.

* * * * *